US006457982B1

(12) United States Patent
Ko et al.

(10) Patent No.: US 6,457,982 B1
(45) Date of Patent: Oct. 1, 2002

(54) INTERFERENCE PREVENTION GROUNDING MECHANISM

(75) Inventors: Sheng-Ching Ko; Shin-Fu Wei, both of Taipei (TW)

(73) Assignee: Jess-Link Products Co., Ltd., Taipei (TW)

( * ) Notice: Subject to any disclaimer, the term of this patent is extended or adjusted under 35 U.S.C. 154(b) by 0 days.

(21) Appl. No.: 09/906,089

(22) Filed: Jul. 17, 2001

(51) Int. Cl.[7] ..... H01R 12/00
(52) U.S. Cl. ..... 439/95; 439/946
(58) Field of Search ..... 439/76.1, 74, 66, 439/95, 609, 718, 96, 946, 607, 108; 361/737, 753, 718

(56) References Cited

U.S. PATENT DOCUMENTS 4,857,005 A * 8/1989 Kirkuchi et al. ..... 439/140
5,378,159 A * 1/1995 Renn ..... 439/59
5,478,260 A * 12/1995 Kaufman et al. ..... 439/609
5,707,244 A * 1/1998 Austin ..... 439/95
5,833,480 A * 11/1998 Austin ..... 439/95
5,893,766 A * 4/1999 Bellas et al. ..... 439/95
5,896,274 A * 4/1999 Ishida ..... 361/737

* cited by examiner

*Primary Examiner*—Neil Abrams
*Assistant Examiner*—J. F. Duverne
(74) *Attorney, Agent, or Firm*—Jacobson Holman, PLLC

(57) ABSTRACT

A connector interference prevention grounding mechanism comprises a circuit board with a connector on one side. The connector has a plurality of slots, each slot contains a sleeve internally. One metal board each is on top and bottom of the connector. Internal to the side slots on both end of the connector has a grounding sleeve. A C-shaped spring tongue is in the middle of the grounding sleeve. A convex point is on the bottom of the metal board and beneath the C-shaped spring tongue. Therefore by the C-shaped spring tongue of the grounding sleeve contacting the convex point of the metal board, the grounding sleeve also connects to the circuitry of the circuit board so that the electromagnetic wave and static electricity absorbed by the metal board can be conducted to the circuit board through the grounding sleeve to eliminate the electromagnetic wave and static electricity.

1 Claim, 5 Drawing Sheets

INTERFERENCE PREVENTION GROUNDING MECHANISM

BACKGROUND OF THE INVENTION CONNECTOR

I. Field of the Invention

This invention relates generally to a connector interference prevention grounding mechanism and, more specifically, to a connector interference prevention grounding mechanism that improves the anti-electromagnetic interference and anti-static electricity effect.

II. Description of the Prior Art

Heretofore, it is known that most of the memory cards for digital cameras and PDA's (Personal Data Assistant) consists of a housing with a circuitry board inside, a connector on one end of the circuitry board, and a metal board on the top and a metal board on the bottom of the connector.

Electromagnetic wave might destroy the data stored in memory chips and cause errors during data transfer of the memory cards. The strong static electricity might conduct from people who touch the memory cards; if the circuitry of the memory cards is not properly grounded, the static electricity can not guide to ground might result the damage to the components of the circuit board, especially the memory chips.

Most of the known metal boards of memory cards do not have a grounding structure or just have poor prevention. The electromagnetic interference might influence the performance stability of the memory cards, the strong static electricity might cause severe damage to the circuitry and break the memory cards. Therefore, it is better to have the metal boards connected to ground to eliminate the electromagnetic wave and static electricity.

Most of the known metal boards of memory cards have only one metal board connected to the circuitry board. The other metal board is in a simpler format and not connected to the circuit board. Therefore, the anti-electromagnetic interference and anti-static electricity effect is insufficient, a better scheme to improve the situation is necessary.

SUMMARY OF THE INVENTION

It is therefore a primary object of the invention to provide an interference prevention grounding mechanism to achieve an anti-electromagnetic interference and anti-static electricity effect for memory cards of digital cameras and PDA's.

In order to achieve the objective set forth, an interference prevention grounding mechanism in accordance with the present invention comprises a circuit board with a connector on one side, the connector has a plurality of slots, each slot contains an internal sleeve. One metal board is on the top and another is on the bottom of the connector. Internal to the side slots on both ends of the connector is a grounding sleeve. A C-shaped spring tongue is in the middle of the grounding sleeve. A convex point is on the bottom of the metal board and beneath the C-shaped spring tongue; therefore by connecting the convex point and the C-shaped spring tongue together can conduct the metal board and the grounding sleeve. The C-shaped spring tongue of the grounding sleeve contacts the convex point of the metal board; and the grounding sleeve also connects to the circuitry of the circuit board. Therefore, the electromagnetic wave and static electricity absorbed by the metal board can be conducted to the circuit board through the grounding sleeve to eliminate the electromagnetic wave and the static electricity.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
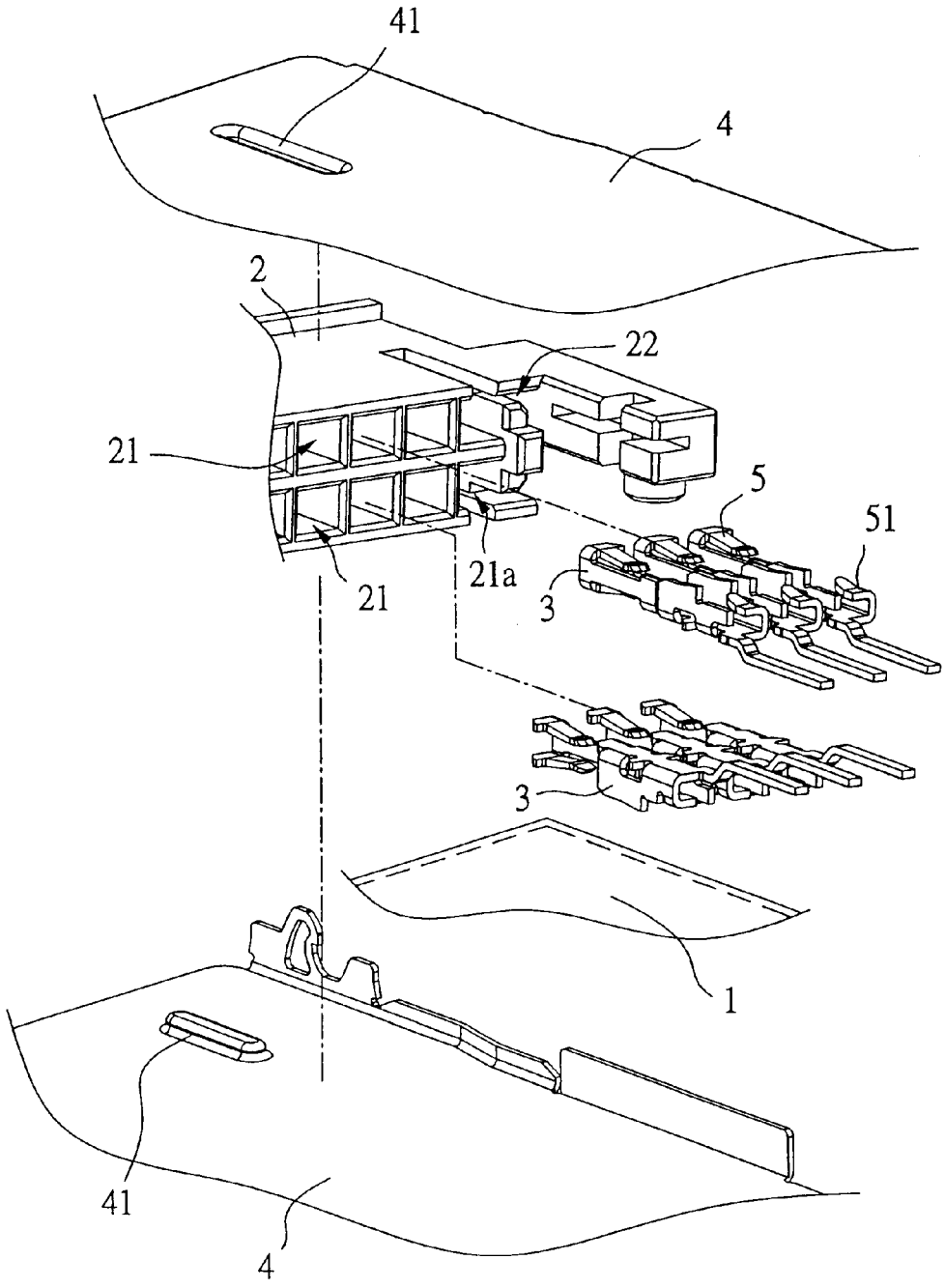
FIG. 1 is an explosive view of the present invention.
Figure 2:
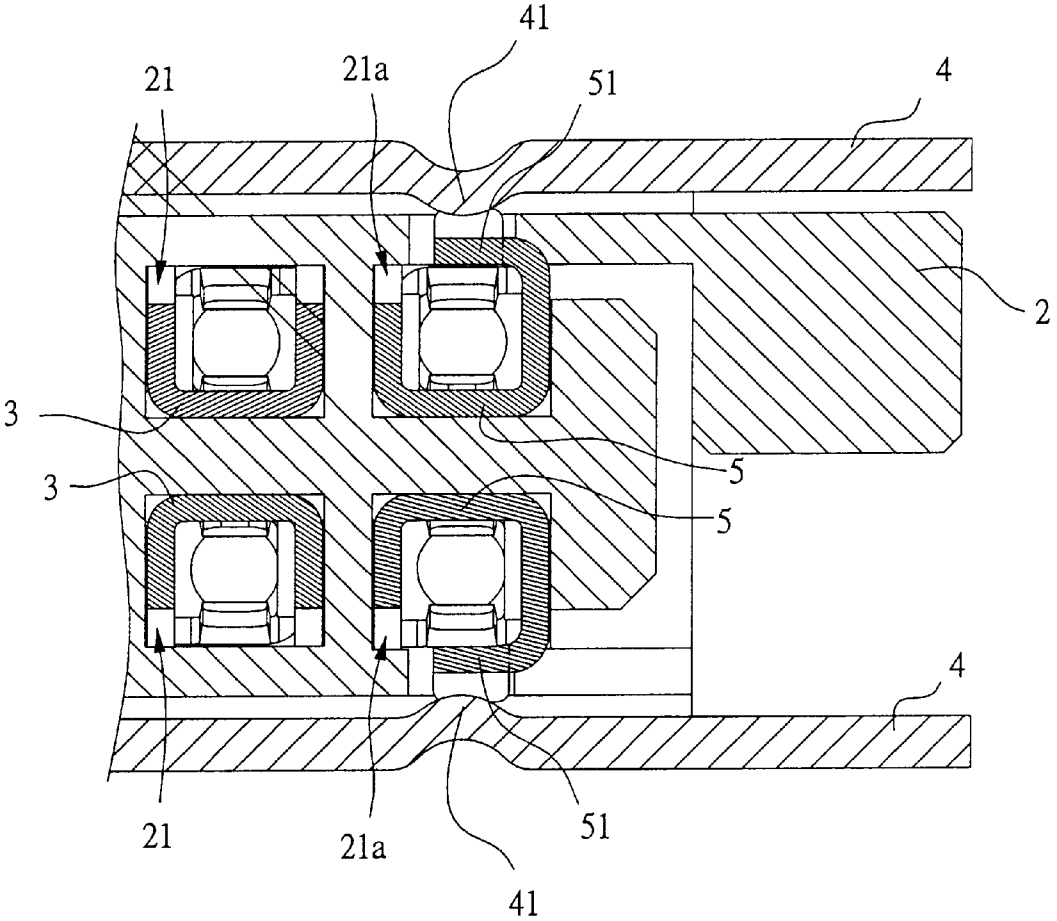
FIG. 2 is a cross-sectional view of the present invention.

Referring to FIG. 1 and FIG. 2, the present invention is composed of a circuit board 1 with a connector 2 on one side, the connector 2 has a plurality numbers of slot 21, each slot 21 contains a sleeve 3 internally. Two metal board 4 are on top and bottom of the connector 2 respectively.

Internal to the side slot 21 a on both end of connector 2 has a grounding sleeve 5. A C-shaped spring tongue 51 is in the middle of the grounding sleeve 5. A convex point 41 is on the bottom of the metal board 4 and beneath the C-shaped spring tongue 51, therefore by connecting the convex point 41 and the C-shaped spring tongue 51 together can conduct the metal board 4 and the grounding sleeve 5.

Based on above description, the C-shaped spring tongue 51 of the grounding sleeve 5 contacts the convex point 41 of the metal board; the grounding sleeve 5 also connects to the circuitry of the circuit board 1, therefore the electromagnetic wave and static electricity absorbed by the metal board 4 can be conducted to the circuit board 1 through the grounding sleeve 5 to eliminate the electromagnetic wave and static electricity. The interference of data storage and transmission by the electromagnetic wave can be avoided, the memory chips on the circuit board 1 are also free from the damage done by the static electricity.

Figure 3:
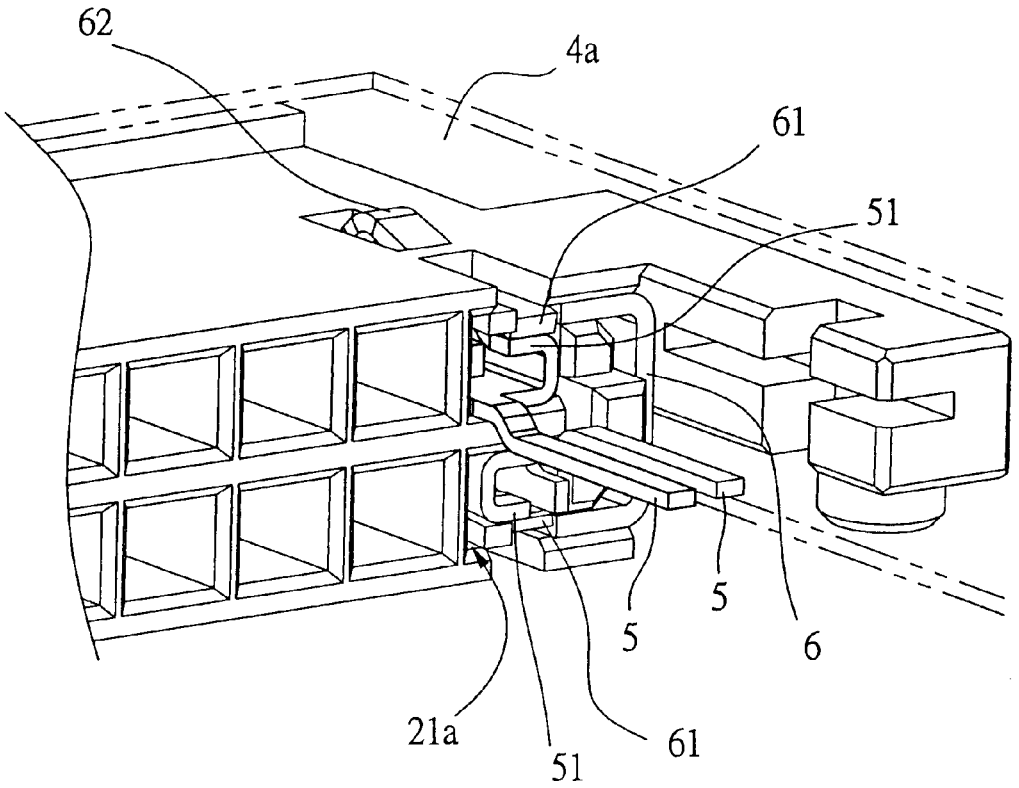
FIG. 3 is a perspective view of a further embodiment of the present invention.
Figure 4:
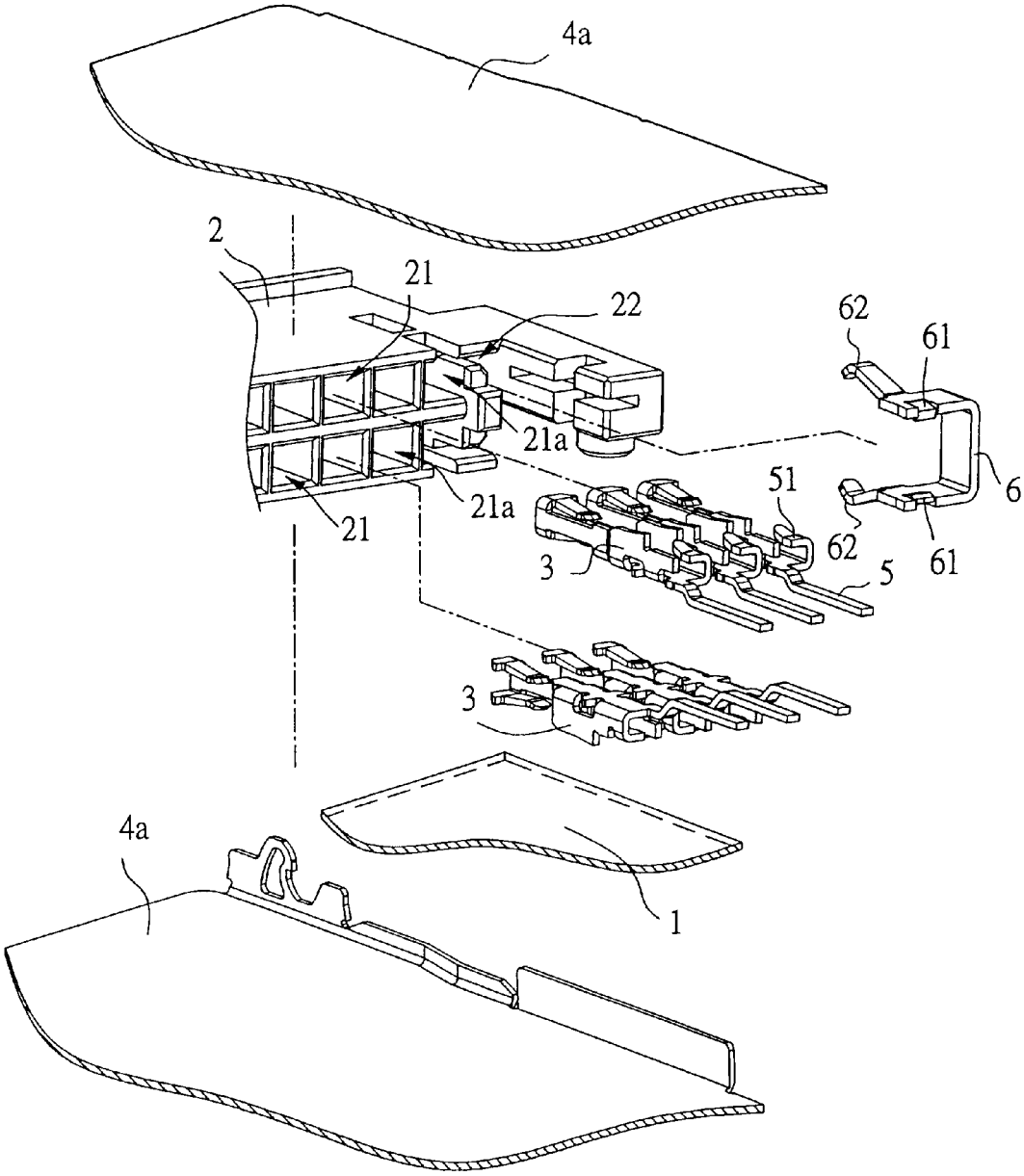
FIG. 4 is an explosive view of a further embodiment of the present invention.
Figure 5:
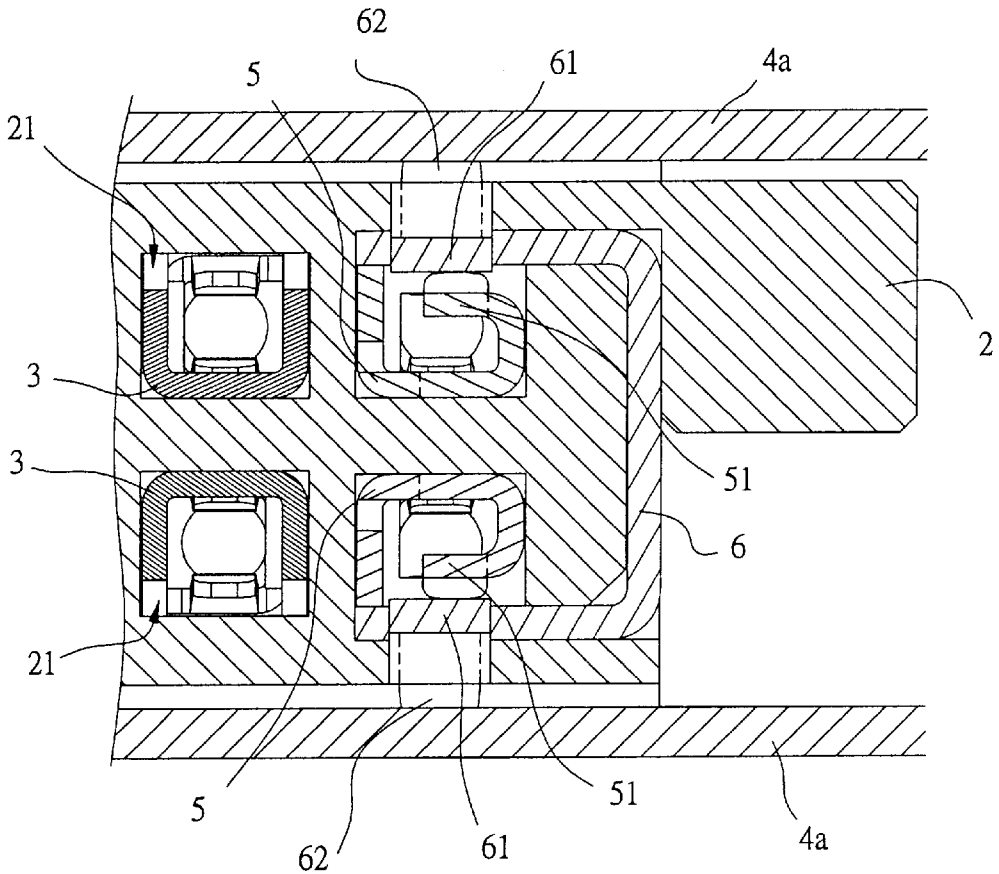
FIG. 5 a cross-sectional view of a further embodiment of the present invention.

Following is another application example of the present invention: referring to FIG. 3, FIG. 4 and FIG. 5, on one side of the grounding sleeve 5 of the connector 2 has a clip groove 22, a C-shaped clip 6 is inside the clip groove 22. A convex point 61 in on top and bottom of the C-shaped clip 6; the convex point 61 the C-shaped clip 6 contacts the C-shaped spring tongue 51 of the grounding sleeve 5. A spring tongue 62 is on the C-shaped clip 6, the spring tongue 62 contacts on the bottom of the other metal board 4*a*.

The C-shaped clip 6 is equipped inside the clip groove 22 of the connector 2. The convex point 61 of the C-shaped clip 6 contacts the C-shaped spring tongue 51 of the grounding sleeve. The structure makes the grounding sleeve 5 connect to the C-shaped clip 6, such a scheme makes the spring tongue 62 of the C-shaped clip 6 contact the convex point 41 of the other metal board 4*a*, the two metal boards 4*a* on top and bottom of the connector 2 are conducted together to achieve the same result to eliminate the electromagnetic wave and static electricity. The interference of data storage and transmission by the electromagnetic wave can be avoided, the memory chips on the circuit board 1 are also free from damage by the static electricity.

While a preferred embodiment of the invention has been shown and described in detail, it will be readily understood and appreciated that numerous omissions, changes and additions may be made without departing from the spirit and scope of the invention.

What is claimed is:

1. A connector interference prevention grounding mechanism comprising:

a circuit board with a connector on one side, said connector having a plurality of slots, and each said slot having an internal sleeve;

two metal boards for positioning on top and bottom of said connector;

a grounding sleeve inside one of said slots of said connector;

a C-shaped spring tongue in the middle of said grounding sleeve;

a convex point, on the bottom of said metal board and beneath said C-shaped spring tongue for connecting said convex point and said C-shaped spring tongue together to provide conduction for the metal board and the grounding sleeve;

one side of said grounding sleeve of said connector having a clip groove;

a C-shaped clip positioned inside said clip groove; and a spring tongue positioned on said C-shaped clip, said spring tongue contacts on the bottom metal board.

* * * * *